United States Patent [19]

Treckman

[11] 4,039,790

[45] Aug. 2, 1977

[54] INERTIA SWITCH HAVING RECIPROCATING MASS

[76] Inventor: Frank Treckman, 31306 Schoenherr, Apt. 2, Warren, Mich. 48093

[21] Appl. No.: 671,073

[22] Filed: Mar. 29, 1976

[51] Int. Cl.[2] ..... H01H 35/14

[52] U.S. Cl. ..... 200/61.53

[58] Field of Search ..... 200/61.45–61.53, 200/293–296, 303; 340/71, 261, 262; 346/7

[56] References Cited

U.S. PATENT DOCUMENTS

| | | | |
|---|---|---|---|
| 1,845,848 | 2/1932 | Richards | 200/61.53 |
| 2,344,854 | 3/1944 | Dempsey | 200/61.49 |
| 2,487,433 | 11/1949 | Gardenhour | 200/61.52 |
| 2,553,708 | 5/1951 | Harmon | 200/61.53 |
| 2,930,863 | 3/1960 | Pasieka | 200/61.53 |
| 3,038,151 | 6/1962 | O'Connor, Jr. et al. | 200/61.52 X |
| 3,108,252 | 10/1963 | Torres | 340/262 X |
| 3,161,739 | 12/1964 | Suozzo | 200/61.52 |
| 3,341,851 | 9/1967 | Tracey et al. | 346/7 |
| 3,571,539 | 3/1971 | Kaiser et al. | 200/61.53 |
| 3,663,780 | 5/1972 | Golbeck | 200/294 X |

FOREIGN PATENT DOCUMENTS

| | | | |
|---|---|---|---|
| 324,626 | 9/1920 | Germany | 200/61.48 |

*Primary Examiner*—James R. Scott

*Attorney, Agent, or Firm*—Gust, Irish, Jeffers & Rickert

[57] ABSTRACT

An inertia mass is supported in a housing for movement along a given path. Two pair of spring blades are cantilever-mounted in the housing. Movement of the mass in one direction closes the first pair of blades and movement in a second direction closes the second pair of blades. Adjustment members are mounted in the housing and bear against one of the blades in each pair to adjust the switching sensitivity. The blades and a warning member, such as an electric light, are mounted in the base of a channel shaped member which snaps into an outer housing shell. A transparent cap is mounted on the housing shell making visible the warning light. Housing flanges are convexly formed and have a plurality of parallel ribs which may be adapted to a large variety of supporting flanges. In one embodiment, the mass is slidable on an elongate rod. Also, the mass may be suspended on two of the spring blades.

15 Claims, 18 Drawing Figures

INERTIA SWITCH HAVING RECIPROCATING MASS

BACKGROUND OF THE INVENTION

1. Field of the Invention

This invention is in the field of inertial switches especially those switches which are adapted to provide a warning signal or a corrective signal for excessive vehicle inertial changes.

2. Description of the Prior Art

A large number of devices are known in the art for providing a signal upon excessive inertial changes in a body movement. These devices all strive to provide simplicity of construction, inexpensive manufacture, mounting adaptability, especially in a vehicle environment, and reliability of operation. Basically, these devices utilize an inertial weight which is mounted to sense inertial changes and provide a signal corresponding thereto. However, none of the known prior art devices are of a simple and durable construction and possess adaptability enabling them to become widely used.

SUMMARY OF THE INVENTION

A housing has an inertial mass mounted for movement therein along a given path. A first pair of conductive spring blades are cantilever-mounted in said housing, the free ends of which extend in the path of said mass and are resiliently deformable into engagement by movement of the mass in a first direction. A second pair of conductive spring blades are cantilever-mounted in said housing, the ends of which extend in the path of said mass and are resiliently deformable into engagement by movement of said mass in a second direction. A warning or corrective circuit is coupled to each pair of blades and is activated when the blades in either pair are conductively engaged due to movement of said mass.

The blades and mass are mounted on the base of a channel-shaped member the sides of which have tabs for snapping into slots in an outer housing shell. Also mounted on the base is a warning light coupled in the warning circuit, becoming illuminated upon the closure of the blades in either pair. A transparent cap is fastened to the housing top in viewable position by a vehicle operator. Bottom flanges on the housing are convexly formed and have a plurality of parallel ridges which may be contoured to fit almost any internal vehicle surface.

Adjustment bolts are mounted on opposite sides of the housing shell and extend through the channel sides and are engageable with the outer blades in each pair to position and support said blades to provide a sensitivity adjustment for blade closure.

In a first embodiment, the mass is slidable along an elongate rod mounted in the housing. In another embodiment, the inertial mass is guided between the inner blades of each pair and is conductively engageable with the outer blades upon movement of the mass in one direction or the other. The inner blade of one pair is integrally formed with the outer blade of the other pair whereby only two U-shaped blade sections are required for both pair of blades. The base of the first U-shaped section is mounted on one housing wall and the base of the other U-shaped section is mounted on the opposite housing wall, with the ends of the blades extending towards one another in overlapping relation to provide a conductive contact on a predetermined mass movement. If desired, blade relationship could be reversed at either end to provide a smaller U-shaped section mounted within a larger section to accomplish the same purpose. If further desired the inertial mass could be supported on the inner blades rather than the walls of the housing.

Guiding ridges and webs are provided in the housing to restrain transverse movement of the weight from its given path. Also, stops are provided in the housing to limit of the movement of the weight along its path after respective contacts have been made between the first pair or second pair of blades.

Thus, when the apparatus of this invention is used in a motor vehicle, abrupt changes in the speed, attitude, or direction of the vehicle which might result in increased danger and cost of vehicle operation may be substantially reduced by an automatic signaling system that would inform the vehicle operator, who might otherwise be unaware of such dangerous and costly vehicle driving habits. For example, the device of this invention can signal the operator whenever a pre-set limit of change in acceleration or deceleration of the vehicle is exceeded to give a visual or audible signal or initiate some corrective action in the vehicle power train or suspension. Further, when a pre-set limit of vehicle attitude is exceeded, as might be occasioned by sharp cornering or operation of the vehicle on a grade, a signal would be given to again alert the operator to such unsafe conditions. The device of this invention is particularly useful to warn the operator when the vehicle is accelerated or decelerated on a grade, the combination of forces being otherwise difficult to ascertain and could lead to a dangerous operating condition.

It is therefore an object of this invention to provide an economical, simple, durable inertia signal device.

It is a further object to provide in the device of the foregoing object a compact unit that may be easily and readily adapted for mounting to practically any contour in the vehicle interior.

It is a further object of this invention to provide an apparatus of the foregoing objects which is structurally durable and of inexpensive manufacture whereby multiple units may be economically feasible for use in a vehicle to provide a warning or protective signal upon excessive vehicle inertial or attitudinal changes.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
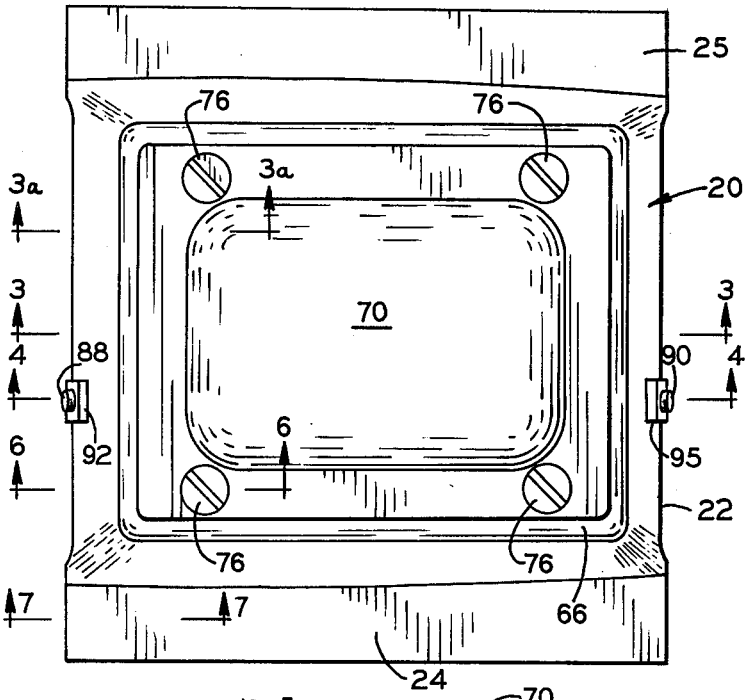
FIG. 1 is a top plan view of a preferred embodiment of this invention.
Figure 2:
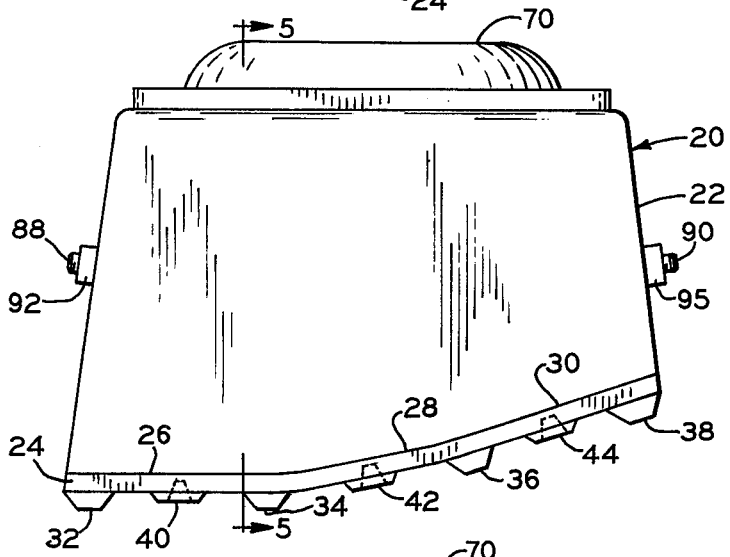
FIG. 2 is an elevational view of a preferred embodiment of FIG. 1.
Figure 3:
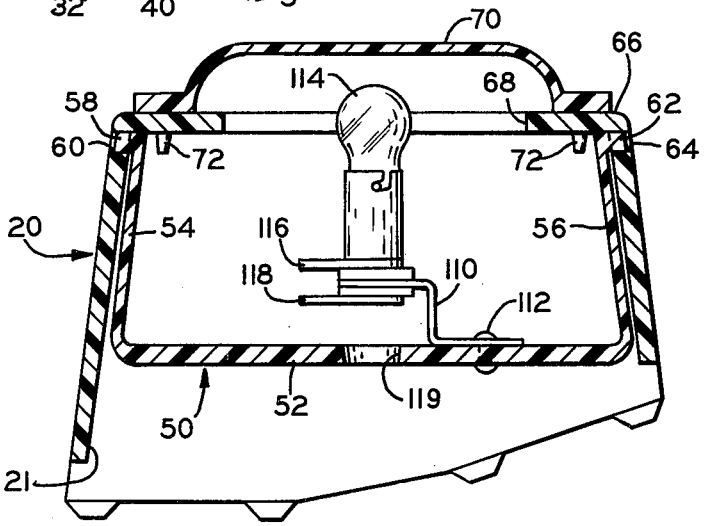
FIG. 3 is a section taken at 3—3 of the embodiment of FIG. 1.
Figure 4:
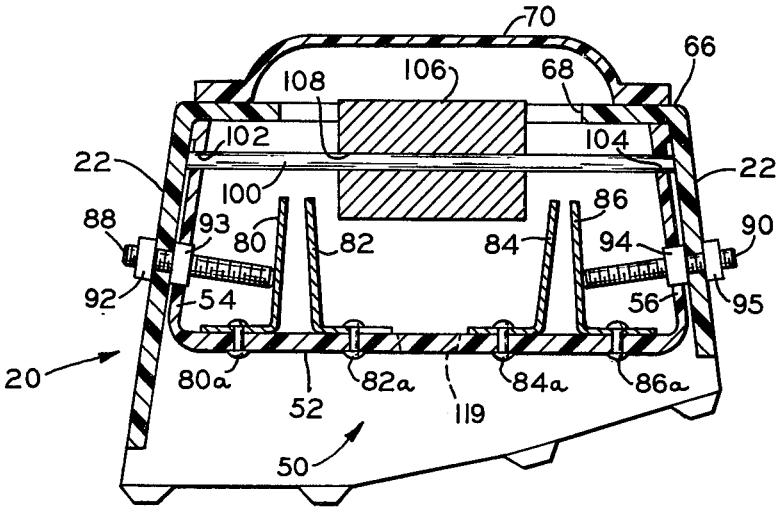
FIG. 4 is a section taken at 4—4 of the embodiment of FIG. 1.
Figure 5:
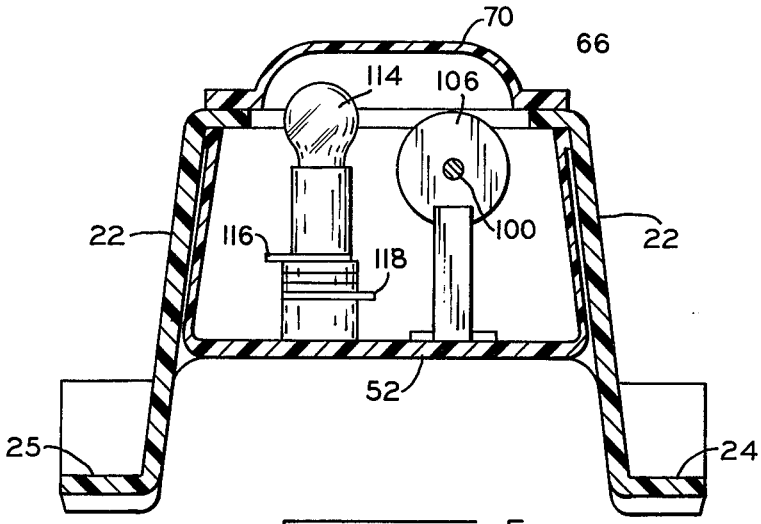
FIG. 5 is a section taken at 5—5 of the embodiment of FIG. 1.
Figure 6:
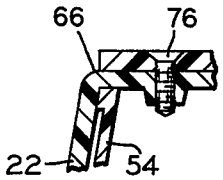
FIG. 6 is a partial section taken at 6—6 of the embodiment of FIG. 1.

Referring to FIGS. 1-7, housing 20, which may be of a molded plastic, has an outer shell 22 with convexly formed bottom flanges 24 and 25, each having planar panels 26, 28 and 30. The angles defined between the upper surfaces of panels 26 and 28, the panels 28 and 30 are obtuse. Abutments 32, 34 36 and 38 are formed on flanges 24 and 25 and may be shaped to fit a very large range of interior vehicle contours, or other mounting surfaces. Blind holes 40, 42 and 44 are formed on each of flanges 24 and 25 to receive fastening members, not shown, for attachment to such surfaces.

A channel shaped inner housing 50 has a base 52 and upwardly extending walls 54, 56. Wall 54 has a tab 58 which is snappable into slot 60 of shell 22 and wall 56 has a tab 62 which is snappable into slot 64 in shell 22 upon insertion of housing 50 into shell 22 through the bottom opening 21. Shell 22 has a top surface 66 with a relatively large central opening 68 formed therein. A cap 70, of a transparent, translucent, or slotted surface is secured to shell 22 over opening 68. Depending from the periphery of cap 70 are a plurality of circumferentially spaced, conically shaped lugs 72 which are received in corresponding openings 74 of top 66 to locate cap 70 on top 66. Screws 76 secure cap 70 on top 66.

Resilient conductive spring blades 80, 82, 84 and 86 are cantilever-mounted by rivets 80*a*, 82*a*, 84*a*, and 86*a*, respectively, to base 52 and are generally upstanding therefrom. Threaded set screws 88, 90 extend through the walls of shell 22 and the walls 54 and 56, respectively, of member 50 and are adjustably secured by nuts 92, 93 and 94, 95, respectively. Screws 88 and 90 bear respectively against blades 80 and 86 to provide switching sensitivity, as will become apparent. Elongate cylindrical rod 100 is mounted in apertures 102 and 104 in walls 54, 56 respectively and inertia mass 106 has a longitudinal bore 108 for receiving rod 100 in loosely sliding relationship. When housing 20 is subject to an inertial change to the right, as viewed in FIG. 4, inertial mass 106 will slide leftwardly on rod 100 engaging and deforming blade 82 leftwardly to make physical and electrical contact with blade 80. In like manner, an inertial change of housing 20 in a leftward direction, will cause relative rightward sliding of mass 106 on rod 100 with mass 106 contacting blade 84 deflecting it rightwardly to make physical and electrical contact with blade 86. Mass 106 may be formed of a heavy,, dense material.

Also cantilever-mounted on base 52 is bracket 110 which is riveted at 112. Warning light 114 having electrical leads 116, 118 is mounted on and supported by bracket 110. The edges of opening 68 are in the path of movement of mass 106 and provide a limit of mass travel. The edges of opening 68 are so positioned that the travel of mass 106 is not limited before the blade pairs 80, 82 or 84, 86 are closed but the travel is limited before any permanent deformation of the spring blades takes place.

Figure 8:
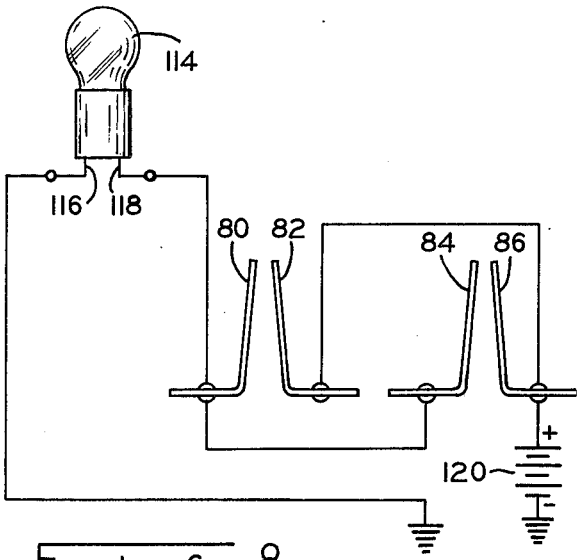
FIG. 8 is a schematic circuit diagram of the embodiment of FIG. 1.
Figure 7:
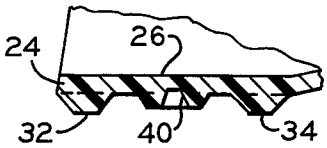
FIG. 7 is a partial section taken at 7—7 of the embodiment of FIG. 1.
Figure 3A:
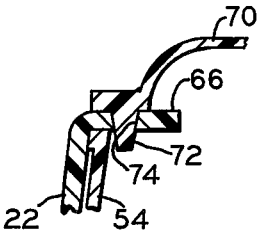
FIG. 3*a* is a section taken at 3*a*—3*a* of the embodiment of FIG. 1.

Referring to FIG. 8, it is seen that when either blades 80 and 82 come into physical and electrical contact or blades 84 and 86 come into physical and electrical contact, a circuit is completed between a battery 120, which may be the vehicle battery, and light 114 thus causing illumination thereof. By positioning housing 20 in a convenient, viewable, vehicle interior position, the driver is instantly aware of any excessive vehicle inertial movement, informing the operator to take corrective action to prevent a dangerous driving condition from developing. Also, the driver is informed of an inefficient range of operation of his vehicle since fuel consumption and vehicle wear is generally increased during such excessive inertial changes. After the inertial forces have subsided, spring blades 82 or 84 will return to their initial positions, opening the circuit between battery 120 and light 114. Aperture 119 (FIG. 3) provides passage for the electrical leads, not shown in FIG. 3, from blades 80, 82, 84 and 86 and terminals 116 and 118.

Figure 9:
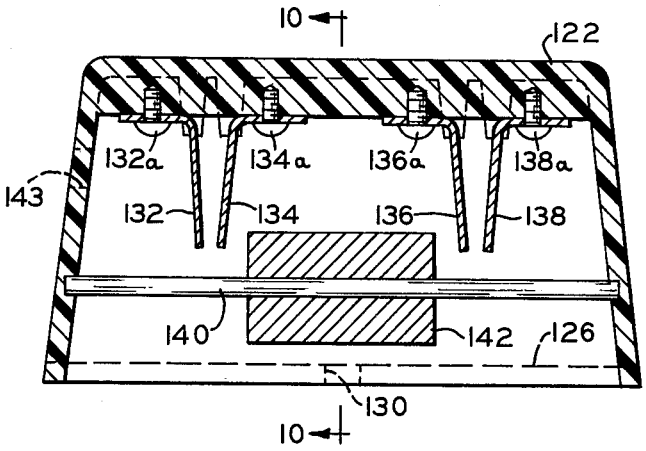
FIG. 9 is a sectional view of a second embodiment of this invention.
Figure 9A:
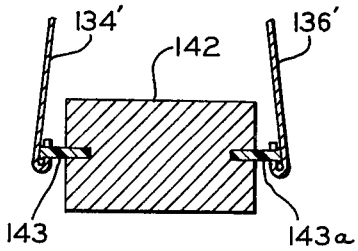
FIG. 9*a* is a partial sectioned view of a variation of the embodiment of FIG. 9 wherein the mass is mounted to two of the blades instead of on a rod, all other structure being the same.
Figure 10:
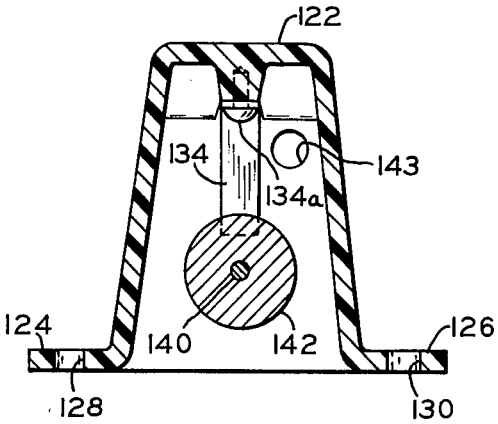
FIG. 10 is a section taken at 10—10 of the embodiment of FIG. 9.
Figure 11:
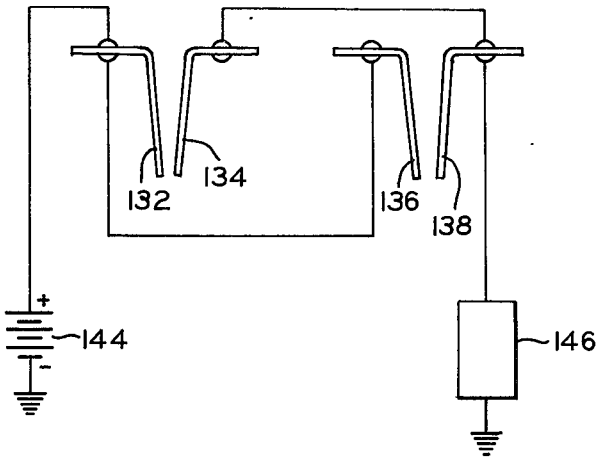
FIG. 11 is a schematic circuit diagram of the embodiment of FIG. 9.
Figure 12:
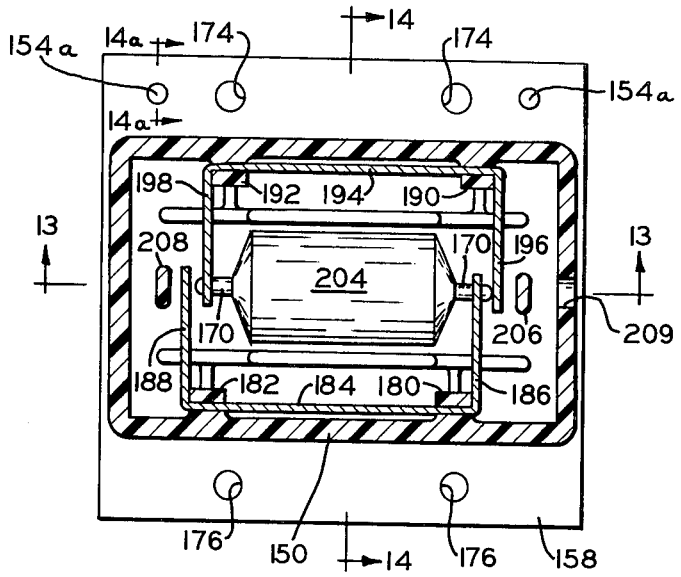
FIG. 12 is a sectional view of a third embodiment of this invention.
Figure 13:
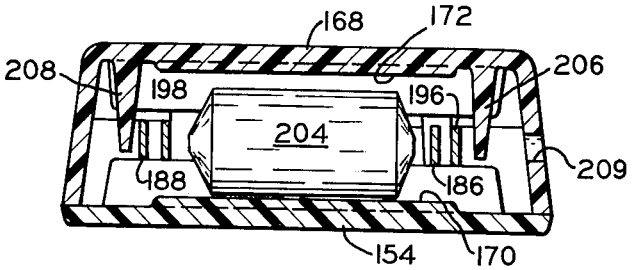
FIG. 13 is a section taken at 13—13 of the embodiment of FIG. 12.
Figure 14:
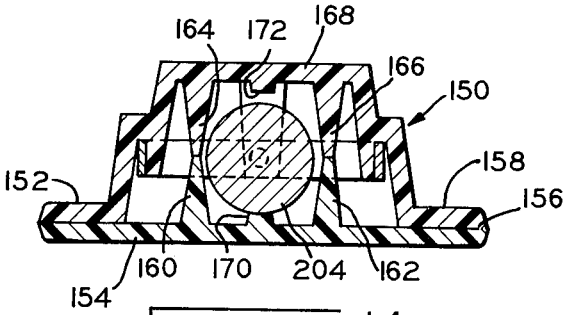
FIG. 14 is a section taken at 14—14 of the embodiment of FIG. 12.

Referring now to FIGS. 9-11, a second embodiment of this invention has a housing 122, which may be of a molded plastic material, having flanges 124 and 126 with openings 128 and 130, respectively, for receiving fastening members for mounting on a supporting surface, not shown. Cantilever-mounted in housing 122 are resilient, conductive spring blades 132, 134, 136 and 138 which are bolted respectively by bolts 132*a*, 134*a*, 136*a* and 138*a* to housing 122. A cylindrical elongate rod 140 is mounted at each end in the walls of housing 122 and slidably supports an inertia mass 142. Aperture 143 is provided for electrical leads, not shown in FIGS. 9 and 10, from blades 132, 134, 136 and 138. The operation of this embodiment is similar to that of the previous embodiment and is of a simple, and economical design. Inertial changes of housing 122 cause corresponding sliding movement of mass 142 on rod 140 causing physical and electrical contact between blade pair 132, 134 or blade pair 136, 138 depending upon the direction of inertial change. Referring to FIG. 11, closure of either blade pair 132, 134 or blade pair 136, 138 completes the circuit between battery 144 and a warning device 146, which may be an illumination and/or sound warning, or a corrective circuit to automatically correct vehicle operation. Upon return to normal vehicle operation, spring blade 134 or 136 will return to its normal position, opening the circuit to warning or corrective device 146. Mass 142 may be provided with insulative pins 143, 143*a*, and mounted to and supported by blades 134' and 136', as shown in FIG. 9*a*, making rod 140 unnecessary.

Referring to FIGS. 12–15, a third embodiment of this invention has a housing 150 which has a flange 152 extending from one side thereof, and a flap 154 which is folded at 156 to form a flange 158 extending from the opposite side thereof. Flap 154 has lugs 154*a* for fastening to flange 152 to complete a bottom surface for housing 150. Flap 154 has formed thereon two elongate web sections 160, 162 which register with and are in physical contact with web sections 164, 166, respectively, depending from top 168 of housing 150. Also formed on flap 154 is elongate retaining ridge 170 and formed oppositely of ridge 170 on top 168 is elongate retaining ridge 172. Mounting holes 174 are formed in flange 152 and hole 176 are formed in flange 158 to receive mounting hardward, not shown. Formed on one side of housing 150 are molded seats 180, 182 for receiving and retaining U-shaped, resilient, elongate conductive member 184 having legs 186, 188 extending from the ends thereof respectively. Formed on the opposite wall of housing 150 are molded seats 190, 192 for receiving and retaining a resilient, elongate, conductive U-shaped member 194 having legs 196 and 198 extending from the ends thereof. Mass 204 is supported for movement along its longitudinal axis by webs 160, 164, 162 and 166 and ribs 170 and 172 and when housing 150 is subjected to an inertial rightward movement (FIG. 12), mass 204 will make contact with leg 198 closing blades 188 and 198 and when housing 150 is subjected to a leftward inertial change exceeding a predetermined limit, mass 204 will make contact with leg 186 closing blades 186 and 196. Stop 206 is formed on and depends from top 168 and serves to limit the rightward movement of mass 204 in housing 150 and stop 208 is formed on and depends from top 168 to provide a leftward limit of travel of mass 204. Aperture 209 is provided for electrical leads, not shown in FIGS. 12 and 13, from members 184, 194.

Figure 15:
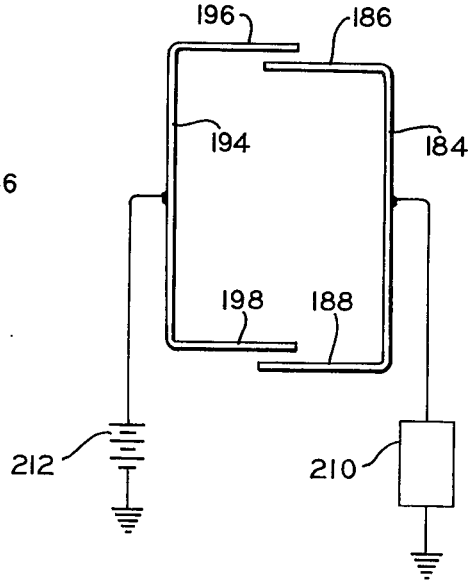
FIG. 15 is a partial schematic circuit diagram of the embodiment of FIG. 12.
Figure 14A:
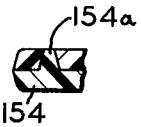
FIG. 14*a* is a partial section taken at 14*a*—14*a* of the embodiment of FIG. 2.

Referring to FIG. 15, the circuit for energizing a warning and/or corrective circuit 210 has battery or power source 212 which is electrically coupled to circuit 210 upon the closure of either blades 186 and 196 or blades 188 and 198. The blade contacts are opened when the inertial forces have subsided due to the blade resilience. In this embodiment only two conductive members 184 and 194, are required, thereby simplifying circuit construction. Further, members 184 and 195 may be of different sizes and mounted on the same side of housing 150, the smaller one nested within and insulated from the larger one. The housing members in all of the foregoing embodiments are made of an insulative material which may be a molded plastic.

While there have been described above the principles of this invention in connection with specific apparatus, it is to be clearly understood that this description is made only by way of example and not as a limitation to the scope of the invention.

What is claimed is:

1. Inertial switch apparatus comprising:

a housing;

an energizable circuit;

an inertial mass mounted for movement in said housing in opposite directions from a normal position along a given linear path;

a first conductive spring blade mounted in said housing and having a portion extending transversely in said path and resiliently deformable by movement of said mass in one direction away from said normal position;

a second conductive spring blade mounted in said housing and having a portion extending transversely in said path and resiliently deformable by movement of said mass in a second direction away from said normal position;

a third conductive blade mounted in said housing and having a portion extending transversely of said path, said third blade portion being normally spaced from said first blade portion and being engageable in circuit-completing relation therewith when said first blade portion is resiliently deformed by said mass;

a fourth conductive blade mounted in said housing and having a portion extending transversely of said path, said fourth blade portion being normally spaced from said second blade portion and being engageable in circuit-completing relation therewith when said second blade portion is resiliently deformed by said mass;

said first and third blades being coupled in said circuit to energize the same when engaged and said second and fourth blades being coupled in said circuit to energize the same when engaged, said first and third, and second and fourth blade portions being respectively spaced when said mass is in said normal position.

2. The inertial switch apparatus of claim 1 including first and second means in said housing for limiting movement of said mass in said opposite directions; said first means limiting movement of said mass in said one direction after said first and third blades are engaged and said second means limiting movement of said mass in said second direction after said second and fourth blades are engaged.

3. The inertial switch apparatus of claim 2 wherein said first means comprises a first abutment formed in said housing and said second means comprises a second abutment formed in said housing and spaced from said first abutment in said second direction.

4. The inertial switch apparatus of claim 1 including adjustment means for respectively adjustably positioning said third and fourth blades with respect to said first and second blades thereby to adjust the normal spacing therebetween.

5. The inertial switch apparatus of claim 4 wherein said third and fourth blades are cantilever mounted in said housing and are resiliently deformable, said adjustment means comprising a first threaded member adjustably mounted for longitudinal movement in a first housing wall registrable and engageable with said third blade to position said third blade with respect to said first blade; said adjustment means further comprising a second threaded member adjustably mounted for longitudinal movement in a second housing wall and registrable with and engageable with said fourth blade to position said fourth blade with respect to said second blade.

6. The inertial switch apparatus of claim 1 wherein said circuit means includes signal means mounted in said housing and energizable when said circuit is energized.

7. The inertial switch apparatus of claim 6 wherein said signal means comprises an element that becomes illuminated upon energization.

8. The inertial switch apparatus of claim 1 wherein said housing includes one generally convex surface, said one surface having a plurality of parallel abutments formed thereon and spaced therealong and adapted to engage a supporting surface.

9. The inertial switch apparatus of claim 8 wherein said one surface is formed by a plurality of planar panels with adjacent panels forming obtuse angles with one another.

10. The inertial switch apparatus of claim 1 wherein said housing has opposite sides, each of said sides having a slot formed therein; a channel-shaped support within said housing and having a base and two spaced side walls upstanding from said base, each of said side walls having a tab formed thereon and extending therefrom, said tabs being snappable into respective slots to secure said support to said housing sides.

11. The inertial switch apparatus of claim 10 including an elongate rod supported at each end on said support side walls; said mass being loosely slidable on said rod.

12. The inertial switch apparatus of claim 1 wherein said housing includes side walls, and further comprising an elongate rod having ends supported on said side walls, said mass being slidably supported on said rod.

13. The inertial switch apparatus of claim 1 wherein said housing includes opposite sides, said first and fourth blades being integrally joined to form a first U-shaped member, said second and third blades being integrally joined to form a second U-shaped member, said first member being mounted on one said housing side and said second member being mounted on the other said housing side; the free ends of said first and third blades being in overlapping relation and the free ends of said second and fourth blades being in overlapping relation.

14. The inertial switch apparatus of claim 1 including means for guiding said mass for linear movement in said path.

15. The inertial switch apparatus of claim 14, wherein said housing includes opposite walls, said guiding means including webs respectively extending from said opposite housing walls on either side of said path and parallel therewith to guide the movement thereof in a first plane in said path; and elongate ridges formed on said opposite housing walls intermediate said webs on either side of said path and parallel therewith to limit movement of said mass in a second plane transverse to said first plane.

* * * * *